US010808989B2

(12) United States Patent
Yoon et al.

(10) Patent No.: US 10,808,989 B2
(45) Date of Patent: Oct. 20, 2020

(54) REFRIGERATOR

(71) Applicant: Samsung Electronics Co., Ltd, Gyeonggi-do (KR)

(72) Inventors: Su Han Yoon, Gwangju (KR); Byung Su Kim, Suwon-si (KR); Seung Yong Yang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/849,308

(22) Filed: Dec. 20, 2017

(65) Prior Publication Data

US 2018/0180350 A1 Jun. 28, 2018

(30) Foreign Application Priority Data

Dec. 23, 2016 (KR) ..... 10-2016-0178619

(51) Int. Cl.
*F25D 23/06* (2006.01)
*F25D 11/00* (2006.01)

(52) U.S. Cl.
CPC ..... *F25D 23/063* (2013.01); *F25D 11/00* (2013.01); *F25D 23/066* (2013.01); *F25D 23/067* (2013.01)

(58) Field of Classification Search
CPC .... F25D 23/063; F25D 23/066; F25D 23/067; F25D 11/00; F25D 27/00; F25D 2327/00
See application file for complete search history.

(56) References Cited

U.S. PATENT DOCUMENTS 3,142,405 A 7/1964 Johnson
3,165,221 A * 1/1965 Kasady ..... F25D 23/064 220/592.06
5,720,536 A * 2/1998 Jenkins ..... F25D 23/085 312/401
7,905,614 B2 * 3/2011 Aoki ..... F25D 11/02 312/116
8,690,274 B2 * 4/2014 Grutzke ..... F25D 27/00 312/406
8,752,921 B2 * 6/2014 Gorz ..... F25D 23/062 312/406.2
8,864,253 B2 10/2014 Gorz et al.
10,045,638 B2 * 8/2018 Artwohl ..... A47F 3/0434
(Continued)

FOREIGN PATENT DOCUMENTS

AU 3796572 A 7/1973
CA 2778727 A1 11/2013
(Continued)

OTHER PUBLICATIONS

European Search Report dated May 16, 2018 in connection with European Patent Application No. 17 20 9847.
(Continued)

*Primary Examiner* — Hanh V Tran

(57) ABSTRACT

Disclosed herein is a refrigerator including an inner case configured to form a storage compartment, wherein the inner case forms the storage compartment by combining side panels formed in a plate shape between a front frame and a rear panel so that a side surface of the storage compartment is not necessarily formed as an inclined surface, thereby further increasing a capacity of the storage compartment.

14 Claims, 10 Drawing Sheets

(56) References Cited

U.S. PATENT DOCUMENTS

2008/0245788 A1* 10/2008 Choong ..... F24C 15/008 219/758
2008/0247154 A1* 10/2008 Lim ..... F25D 27/00 362/92
2011/0146336 A1* 6/2011 Selin ..... F25D 23/063 62/449
2012/0297794 A1 11/2012 Tuszkiewicz et al.
2015/0145399 A1* 5/2015 Joo ..... F25D 23/02 312/404
2015/0208827 A1* 7/2015 Twohy ..... F25D 27/00 62/3.6
2015/0292795 A1* 10/2015 Shin ..... F25D 27/00 312/404
2016/0010845 A1* 1/2016 Brown ..... F21V 33/0044 362/551
2016/0033194 A1* 2/2016 Sumihiro ..... F25D 23/04 62/125
2016/0169575 A1 6/2016 Yu et al.
2016/0313052 A1* 10/2016 Eicher ..... F25D 27/00
2017/0292776 A1* 10/2017 Kim ..... F25D 21/04
2018/0017317 A1* 1/2018 Adachi ..... F21K 9/64
2018/0187961 A1* 7/2018 Lim ..... F25D 23/067

FOREIGN PATENT DOCUMENTS

CN 102037302 A 4/2011
CN 102455105 A 5/2012
CN 103913040 A 7/2014
DE 2201232 A1 8/1972
DE 102005057143 A1 6/2007
DE 102005057150 A1 6/2007
JP 2517084 B2 7/1996
JP 2000180039 A 6/2000

OTHER PUBLICATIONS

China National Intellectual Property Administration, "The First Office Action," Application No. CN 201711402783.6, dated Oct. 11, 2019, 16 pages.

* cited by examiner

REFRIGERATOR

CROSS-REFERENCE TO RELATED APPLICATION

The present application is related to and claims priority to Korean Patent Application No. 10-2016-0178619 filed on Dec. 23, 2016, the disclosure of which is incorporated herein by reference.

TECHNICAL FIELD

Embodiments of the present disclosure relate to a refrigerator, and more particularly, to an inner case configured to form a storage compartment of a refrigerator.

BACKGROUND

Generally, a refrigerator includes refrigerating cycle elements therein and is an apparatus capable of storing items stored in the refrigerator by freezing or refrigerating the items using cold air generated by an evaporator of the refrigerating cycle.

The refrigerator includes an outer case configured to form an exterior of the refrigerator and an inner case disposed inside the outer case to form a storage compartment, and an insulator, such as urethane, is filled in a space between the outer case and the inner case for heat insulation.

In the refrigerator, the inner case is generally formed by injecting a melted resin into a mold and then curing the resin. Here, in order to separate the cured inner case from the mold, upper, lower, left, and right sides of the inner case forming the storage compartment need to be formed as inclined surfaces.

SUMMARY

To address the above-discussed deficiencies, it is a primary object to provide a refrigerator which allows a capacity of a storage compartment to increase without a change in size of a body thereof.

In addition, it is another aspect of the present disclosure to provide a refrigerator which allows a user to more easily check items stored inside the refrigerator.

Additional aspects of the disclosure will be set forth in part in the description which follows and, in part, will be obvious from the description, or may be learned by practice of the disclosure.

In accordance with one aspect of the present disclosure, there is provided a refrigerator including a body provided with a storage compartment, wherein the body includes an inner case configured to form the storage compartment, and the inner case includes a front frame configured to form a front side end thereof, a plurality of side panels formed in a plate shape and having front ends coupled to the front frame, and a rear panel coupled to rear ends of the plurality of side panels.

The front frame may be formed in a rectangular ring shape, and the plurality of side panels may include four side panels corresponding to four surfaces of the front frame so that an inner surf space of the four side panels forms the storage compartment The plurality of side panels may be formed of a metal material.

Each of the plurality of side panels may include a locking portion formed by a part of the front end of the side panel being bent outward, the front frame may include a front coupling portion coupled to the front end of the side panel, and the front coupling portion may include a locking protrusion with which the locking portion is engaged.

Each of the plurality of side panels may include an elastic portion formed by a part of the rear end of the side panel being bent, and the rear panel may include a rear coupling portion formed in a groove shape so that the elastic portion may be inserted into and supported by an inner surface of the rear coupling portion.

The plurality of side panels may be formed of a ceramic material.

The front frame may include a front coupling portion coupled to each of the front ends of the side panels, and the side panels may be fixed to the front coupling portion using an adhesive material.

The rear panel may include a rear coupling portion formed in a groove shape, so that the rear end of each of the side panels may be inserted into and supported by the rear coupling portion.

The refrigerator may further include an outer case configured to accommodate the inner case therein and an insulator filled in a space between the outer case and the inner case.

The refrigerator may further include a light source disposed in the front frame, wherein the front frame may further include a light source accommodating portion formed to be concave and accommodate the light source, and a light source cover configured to cover the light source accommodating portion.

The light source may include a substrate and a plurality of light emitting diodes arranged to be spaced apart from each other on the substrate.

The refrigerator may further include a hot water pipe through which hot water passes and a magnet configured to generate a magnetic force, wherein a pipe accommodating groove in which the hot water pipe is accommodated and a magnet accommodating groove in which the magnet is accommodated may be provided in a front surface of the front frame.

The refrigerator may further include a frame cover coupled to the front frame and configured to cover the pipe accommodating groove and the magnet accommodating groove.

In accordance with another aspect of the present disclosure, there is provided a refrigerator including a storage compartment, a light source accommodating portion formed to be concave in at least one surface of an upper surface, a lower surface, and both side surfaces of the storage compartment, and a light source accommodated in the light source accommodating portion, wherein the light source accommodating portion extends vertically or laterally, and the light source includes substrates extending in the extending direction of the light source accommodating portion and a plurality of light emitting diodes arranged on the substrates to be spaced apart from each other in the extending direction of the light source accommodating portion.

The light source accommodating portion may include a pair of light source accommodating portions laterally extending on the upper and lower surfaces of the storage compartment and a pair of light source accommodating portions vertically extending on both of the side surfaces of the storage compartment.

The refrigerator may further include a light source cover configured to cover the light source accommodating portion.

The light source cover may be formed of a translucent white material.

The light source cover may be formed to diffuse light generated by the light source.

Each of the upper surface, the lower surface, and the both side surfaces may include a light source accommodating portion.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in this specification and configurations illustrated in drawings are only exemplary examples of the disclosure. It should be understood that the disclosure covers various modifications that may substitute for the embodiments herein and drawings at the time of filing of this application.

Further, identical reference numbers or symbols given in the accompanying drawings of the present specification indicate substantially the same components or components that perform substantially the same function.

Further, terms used in the present specification are used only to describe exemplary embodiments, and are not intended to limit and/or restrict disclosed disclosure. An expression used in the singular encompasses an expression of the plural unless it has a clearly different meaning in the context. In the present specification, it should be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

It should be understood that, although the terms "first," "second," etc. used in the present specification may be used to describe various elements, the elements are not limited by the terms. The terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

In addition, the terms "front end," "rear end," "above/top," "below/bottom," "top end," and "bottom end" used in the present specification are defined with reference to the drawings, but are not limited thereto. The terms do not limit the shape and position of each component.

Hereinafter, a refrigerator in accordance with one embodiment of the present disclosure will be described in detail with reference to the accompanying drawings.

Figure 1:
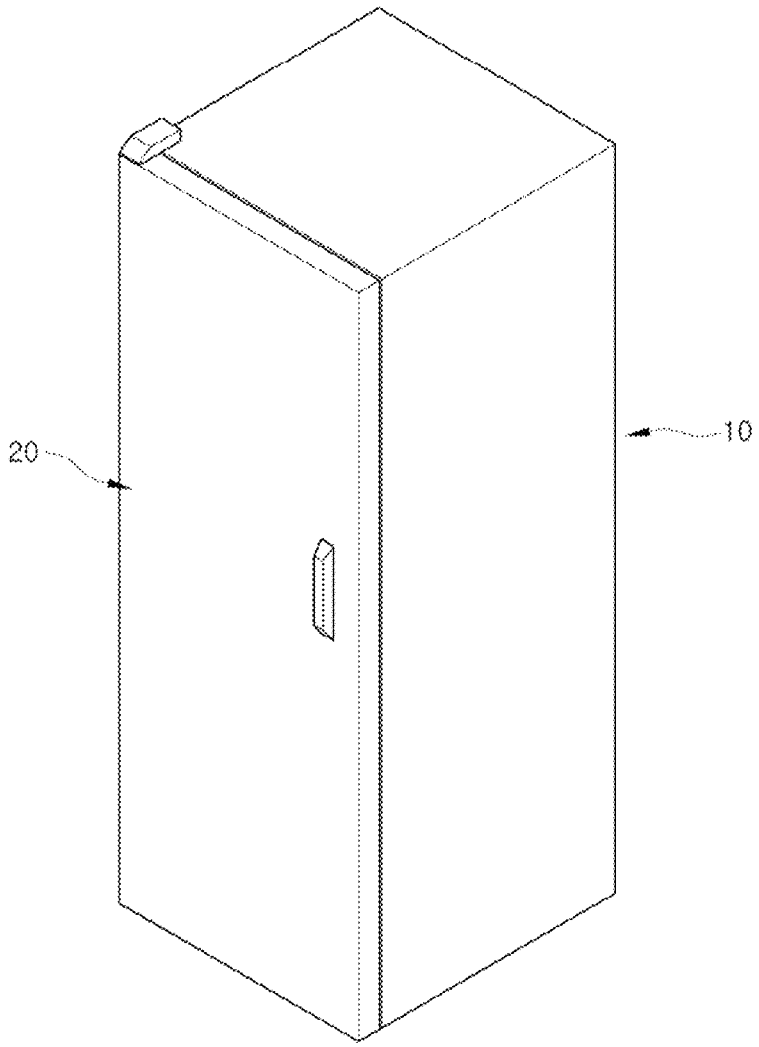
FIG. 1 is a perspective view of a refrigerator in accordance with one embodiment of the present disclosure.

As illustrated in FIG. 1, the refrigerator in accordance with one embodiment of the present disclosure includes a body 10 provided with a storage compartment 12*a* (see FIG.

2) and a door 20 rotatably installed on a front surface of the body 10 and configured to open and close the storage compartment 12*a* while rotating.

Figure 2:
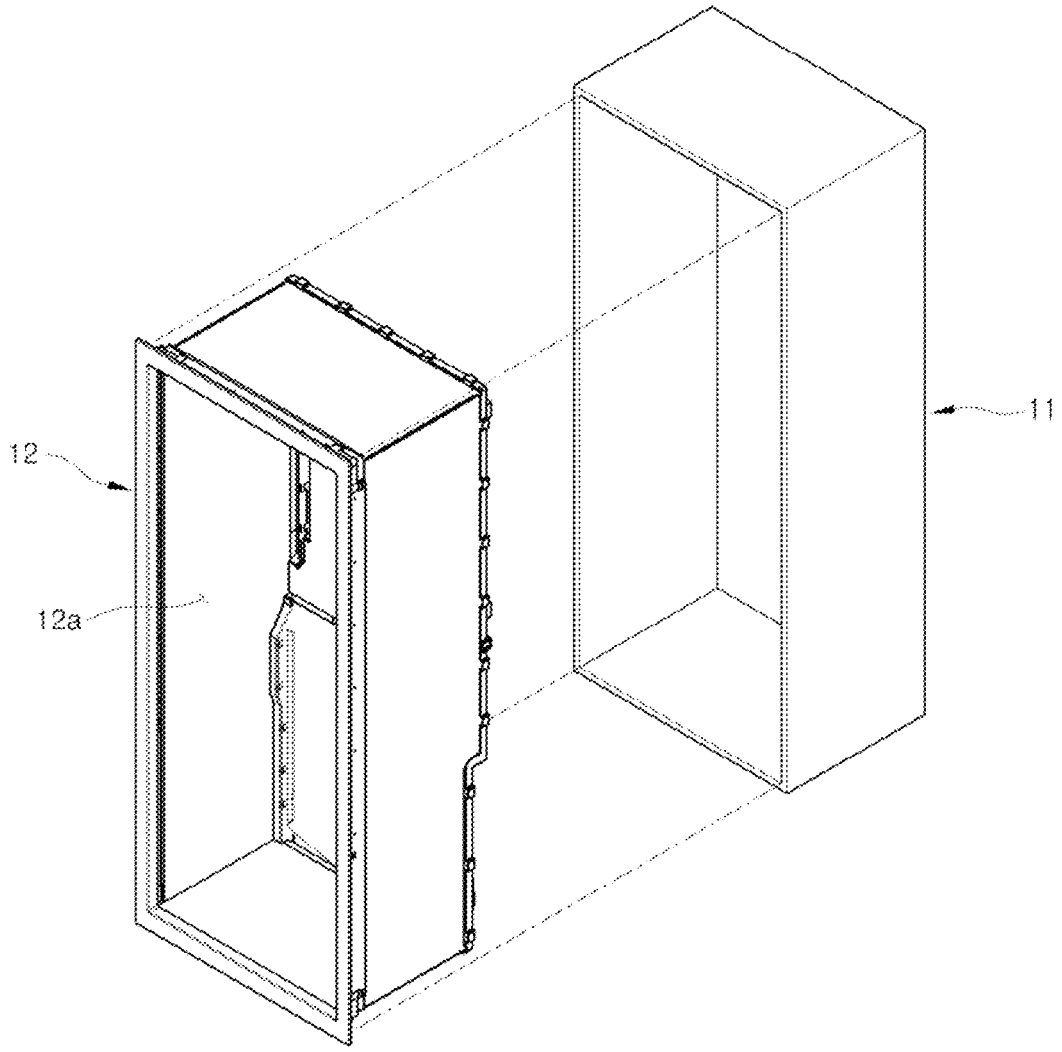
FIG. 2 is a perspective view of an outer case and an inner case of the refrigerator in accordance with one embodiment of the present disclosure.
Figure 3:
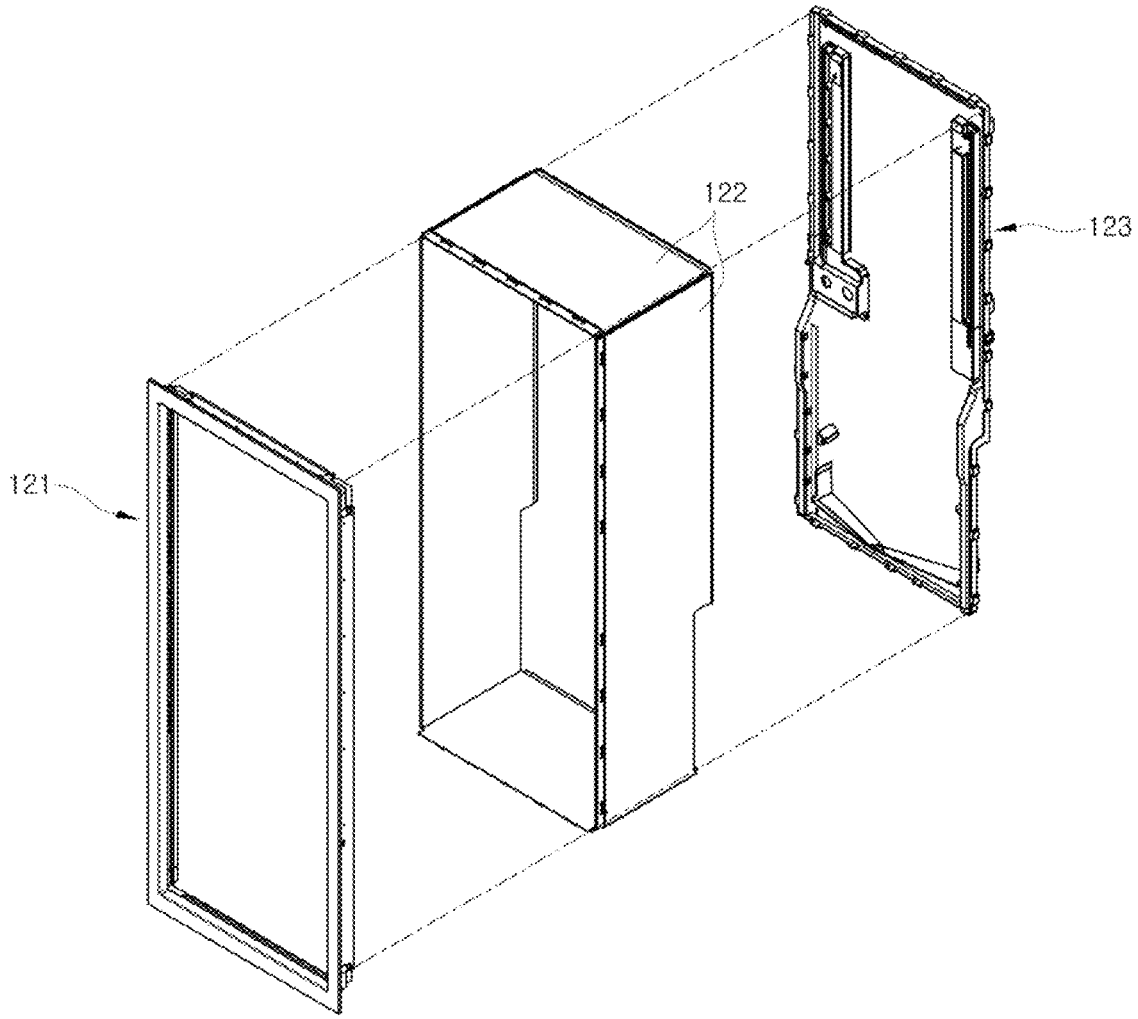
FIG. 3 is an exploded perspective view of the inner case of the refrigerator in accordance with one embodiment of the present disclosure.
Figure 4:
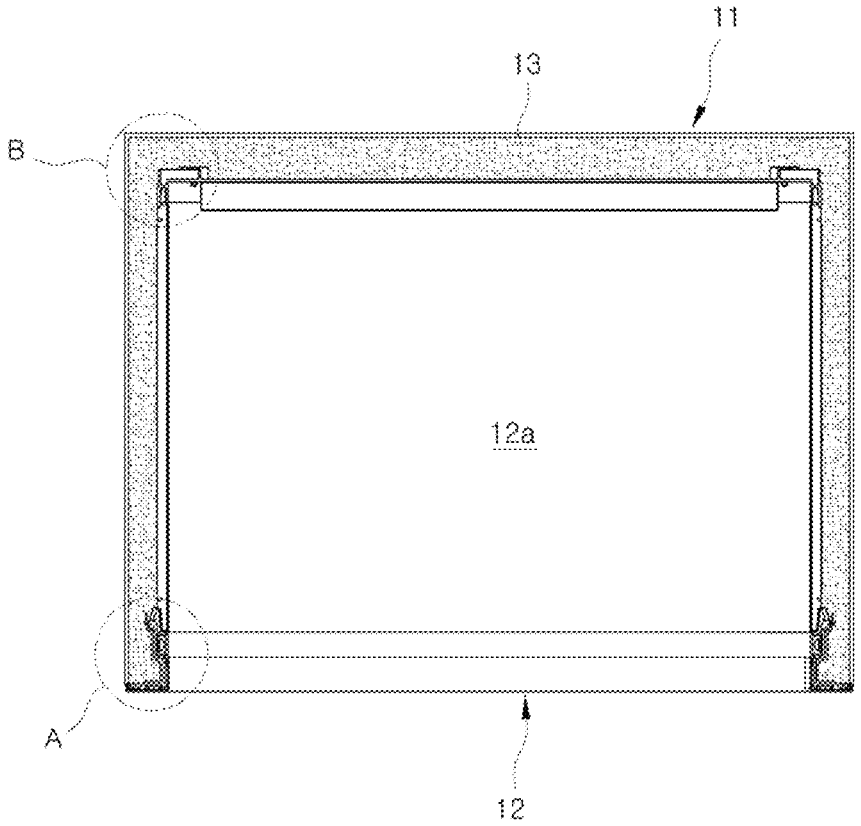
FIG. 4 is a cross-sectional view of a body of the refrigerator in accordance with one embodiment of the present disclosure.
Figure 5:
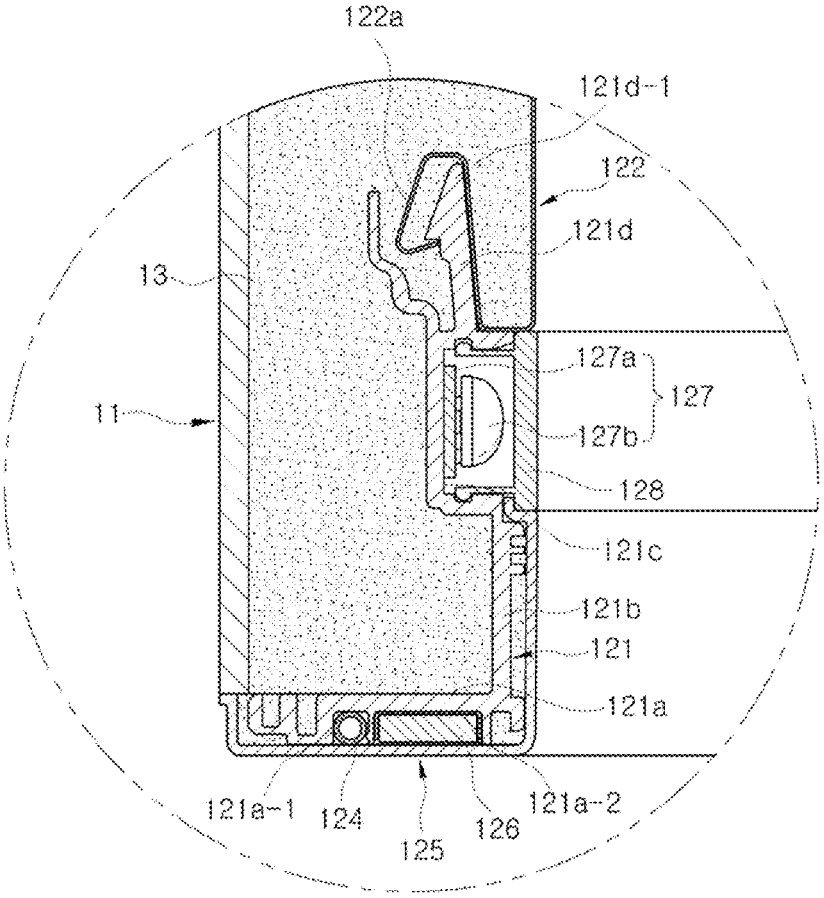
FIG. 5 is an enlarged view of portion A in FIG. 4.
Figure 6:
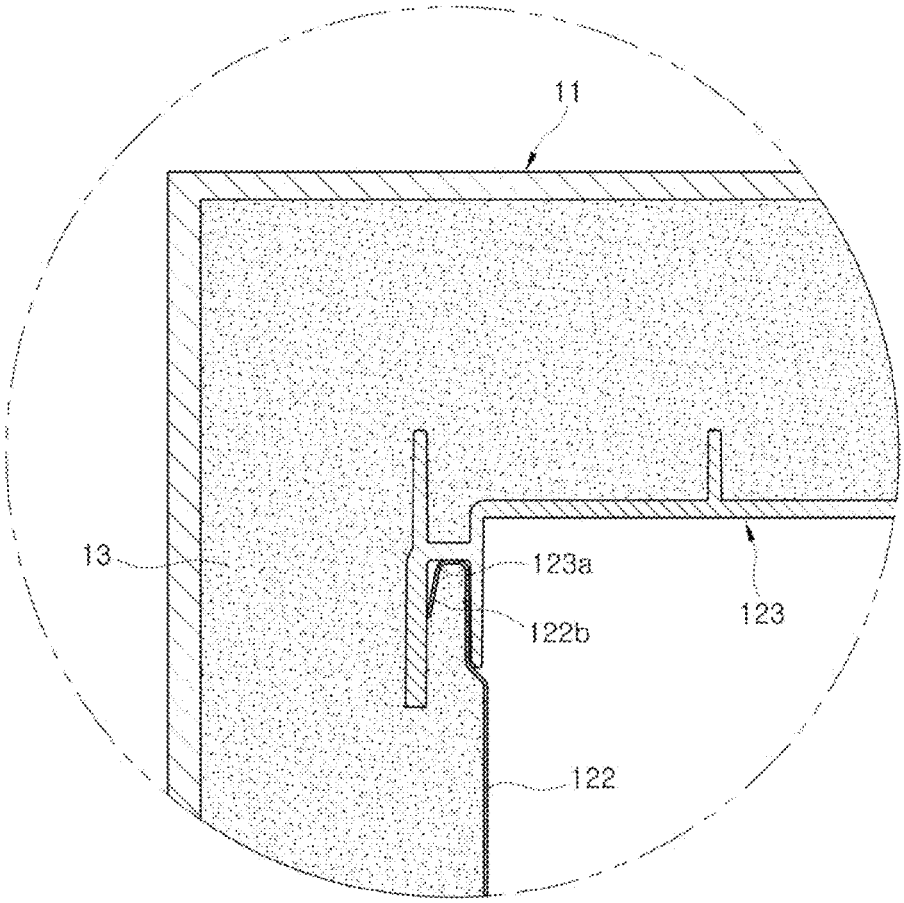
FIG. 6 is an enlarged view of portion B in FIG. 4.

As illustrated in FIG. 2, the body 10 includes an outer case 11 forming an outer surface thereof and an inner case 12 disposed inside the outer case 11 to form the storage compartment 12*a*, and an insulator 13 is filled in a space between the outer case 11 and the inner case 12.

The outer case 11 is formed in a rectangular box shape with an open front surface, and is configured to accommodate the inner case 12 therein.

Hereinafter, a detailed configuration of the inner case 12 will be described with reference to FIGS. 3, 4, 5, and 6.

The inner case 12 includes a front frame 121 forming a front side end portion thereof, side panels 122 formed in a plate shape and coupled to the front frame 121, a rear panel 123 coupled to rear ends of the side panels 122 to support the rear ends of the side panels 122 while forming a rear surface of the inner case 12, and a frame cover 125 coupled to a front side of the front frame 121.

The front frame 121 includes a front surface portion 121*a* formed in a vertically long rectangular ring shape and configured to form a front surface thereof, an extension 121*b* extending rearward from the front surface portion 121*a*, a light source accommodating portion 121*c* formed in a concave shape and configured to accommodate a light source 127, which will be described below, and a front coupling portion 121*d* extending rearward from the light source accommodating portion 121*c* and coupled to front ends of the side panels 122.

A hot water pipe 124 through which hot water passes and a magnet 126 configured to generate a magnetic force so that the door 20 may be in stably contact with the body 10 are disposed on the front surface of the front frame 121. A pipe accommodating groove 121*a*-1 in which the hot water pipe 124 is accommodated and a magnet accommodating groove 121*a*-2 in which the magnet 126 is accommodated are provided in the front surface portion 121*a* of the front frame 121 to accommodate the hot water pipe 124 and the magnet 126. Further, the frame cover 125 is coupled to the front side of the front frame 121 to cover the pipe accommodating groove 121*a*-1 and the magnet accommodating groove 121*a*-2.

The extension 121*b* extends rearward from an inner side end of the front surface portion 121*a* so that an inner surface of the extension 121*b* forms a part of the front side of the storage compartment 12*a*.

The light source accommodating portion 121*c* is provided on the front side of the storage compartment 12*a* and formed to be concave with respect to an inner surface of the storage compartment 12*a* to accommodate the light source 127 that will be described below.

As described above, since the front frame 121 is formed in the rectangular ring shape, four light source accommodating portions 121*c* are provided to correspond to the rectangular ring shaped front frame 121. That is, the light source accommodating portions 121*c* are provided to correspond to an upper portion, a lower portion, and both side portions of the front frame 121, and correspond to an upper surface, a lower surface, and both side surfaces of the storage compartment 12*a*. The light source accommodating portions 121*c* provided at the upper and lower portions of the storage compartment 12*a* are disposed to be elongated in a lateral direction, and the light source accommodating portions 121*c* provided at both sides of the storage compartment 12*a* are disposed to be elongated in a vertical direction.

A total of four light sources 127 are provided to correspond to the four light source accommodating portions 121*c* provided on the upper portion, the lower portion, and both of the side portions of the front frame 121. The light sources 127 include four substrates 127*a* extending in the vertical and lateral directions and accommodated in the light source accommodating portions 121*c* such that each of the light sources 127 corresponds to an extending direction of the light source accommodating portion 121*c*, and a plurality of light emitting diodes (LEDs) 127*b* arranged on the substrates 127*a* to be spaced apart from each other in the extending direction of the light source accommodating portion 121*c*. In the embodiment, each of the LEDs 127*b* includes a lens for diffusing light toward the front side.

The light source accommodating portions 121*c* are coupled with the light source covers 128 covering the concavely formed light source accommodating portions 121*c* so that an outer surface of the light source cover 128 forms a part of the inner surface of the storage compartment 12*a*. The light source cover 128 is formed of a translucent white material and serves to cover the light source 127 and the light source accommodating portion 121*c* and diffuse the light generated by the LED 127*b*. Accordingly, the LED 127*b* and the light source cover 128 operate as a line type light source.

Therefore, since light is supplied to the storage compartment 12*a* by the line type light sources located in four directions of upward, downward, rightward, leftward directions of the storage compartment 12*a*, a portion which the light does not reach is reduced, and thus a user using the refrigerator can more easily check items stored in the storage compartment 12*a*.

The front coupling portion 121*d* includes locking protrusions 121*d*-1 with which locking portions 122*a* of the side panels 122, which will be described below, are engaged so that the side panels 122 may be coupled with the front coupling portion 121*d*.

Four side panels 122 are provided to correspond to the four sides of the front frame 121 formed in the rectangular ring shape so that a rectangular shaped space is formed by the four side panels 122, thereby forming the storage compartment 12*a*.

Therefore, by performing surface treatment on the side panel 122 formed in a plate shape, characteristics of the inner surface of the storage compartment 12*a* can be easily improved. That is, a design is added to one side surface of the side panel 122 in a state in which the side panel 122 is formed in a plate shape, or an antibacterial treatment or surface roughness improvement is performed thereon through a coating operation, and then, the side panel 122 is coupled to a portion between the front frame 121 and the rear panel 123, the characteristics of the inner surface of the storage compartment 12*a* can be easily improved.

The side panel 122 includes an upper surface panel coupled to an upper inner side end of the front frame 121 and having a lower surface forming the upper surface of the storage compartment 12*a*, a lower surface panel coupled to an lower inner side end of the front frame 121 and having an upper surface forming the lower surface of the storage compartment 12*a*, and a pair of side surface panels coupled to inner side ends of both sides of the front frame 121 and having inner side surfaces forming both of the side surfaces of the storage compartment 12*a*.

In the embodiments, the side panel 122 is formed of a metal material, specifically, stainless steel among metals, which is a material resistant to moisture. Since the metal material has excellent thermal conductivity, when the side panel 122 is formed of the metal material, as in the present embodiment, cool air may be transmitted more quickly by the side panel 122 to allow the entire inside of the storage compartment 12*a* to be evenly cooled.

As described above, since the side panels 122 a reformed of a metal, the side panels may be bent. Accordingly, each of the side panels 122 includes the locking portion 122*a* formed by a portion of the front end side of side panel 122 being bent outward, and an elastic portion 122*b* provided at the rear end of the side panel 122 and inserted into and coupled to a rear coupling portion 123*a* of the rear panel 123.

A plurality of the locking portions 122*a* are formed to be spaced apart from each other at the front ends of the side panels 122 and engaged with the above-described locking protrusions 121*d*-1. Further, the elastic portion 122*b* is bent to have an approximate U shape to exhibit elasticity so that the elastic portion 122*b* is elastically supported on an inner surface of the rear coupling portion 123*a*.

The rear panel 123 is formed of a resin material, and the rear coupling portion 123*a*, to which the above-described elastic portion 122*b* of the side panels 122 is coupled, is provided on a front outer side of the rear panel 123. In the present embodiment, the rear coupling portion 123*a* is provided in a groove shape in the front surface of the rear panel 123 so that the elastic portion 122*b* is elastically supported on the inner surface of the rear coupling portion 123*a*.

Next, a manufacturing process of the inner case of the refrigerator constituted as described above will be described in detail with reference to the accompanying drawings.

Figure 7:
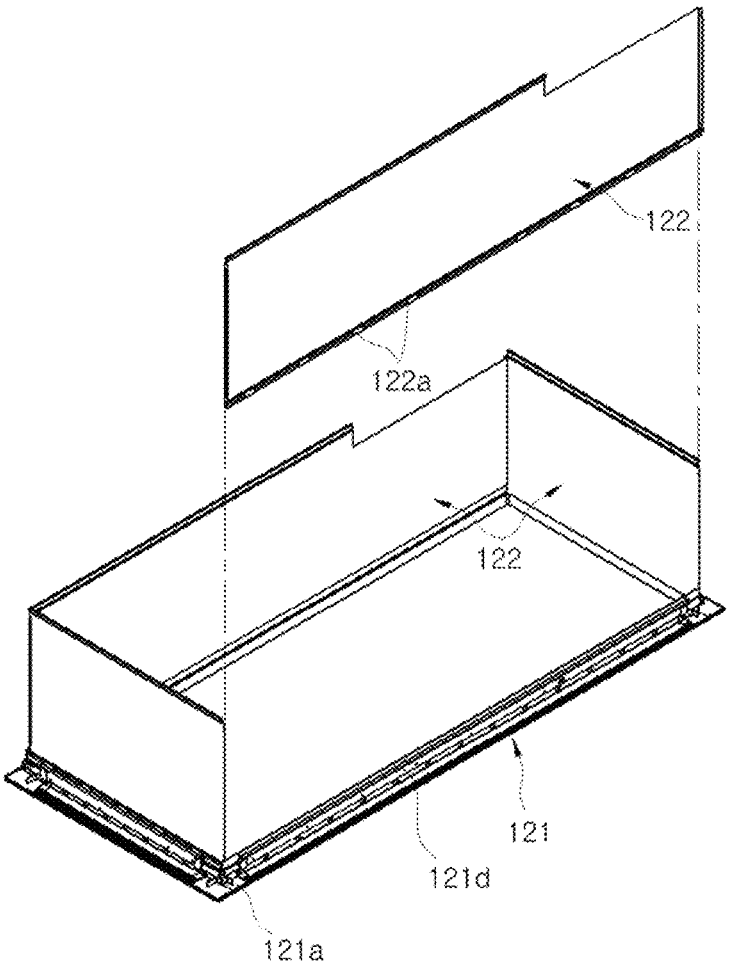
FIGS. 7,8 and 9 are perspective views illustrating a process of manufacturing the inner case of the refrigerator in accordance with one embodiment of the present disclosure.

First, as shown in FIG. 7, the front frame 121 is formed in a rectangular ring shape using four bar-shaped members, and then the front surface portion 121*a* of the front frame 121 is laid on a floor to face downward.

Figure 8:
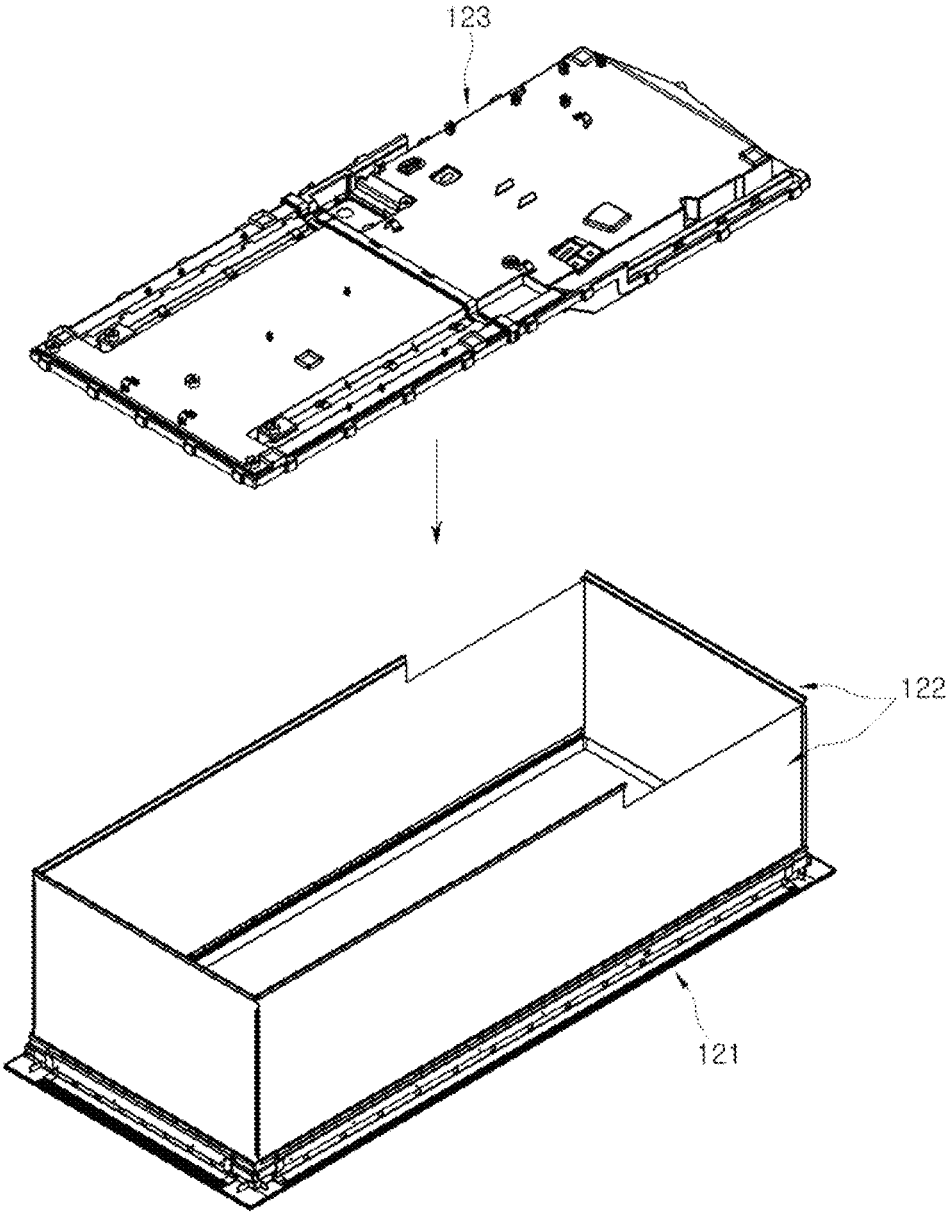

In such a state, front ends of the side panels 122 are sequentially coupled to the front coupling portions 121*d* formed on a rear end side of the front frame 121 so that a rectangular space is formed by the side panels 122, as shown in FIG. 8.

Figure 9:
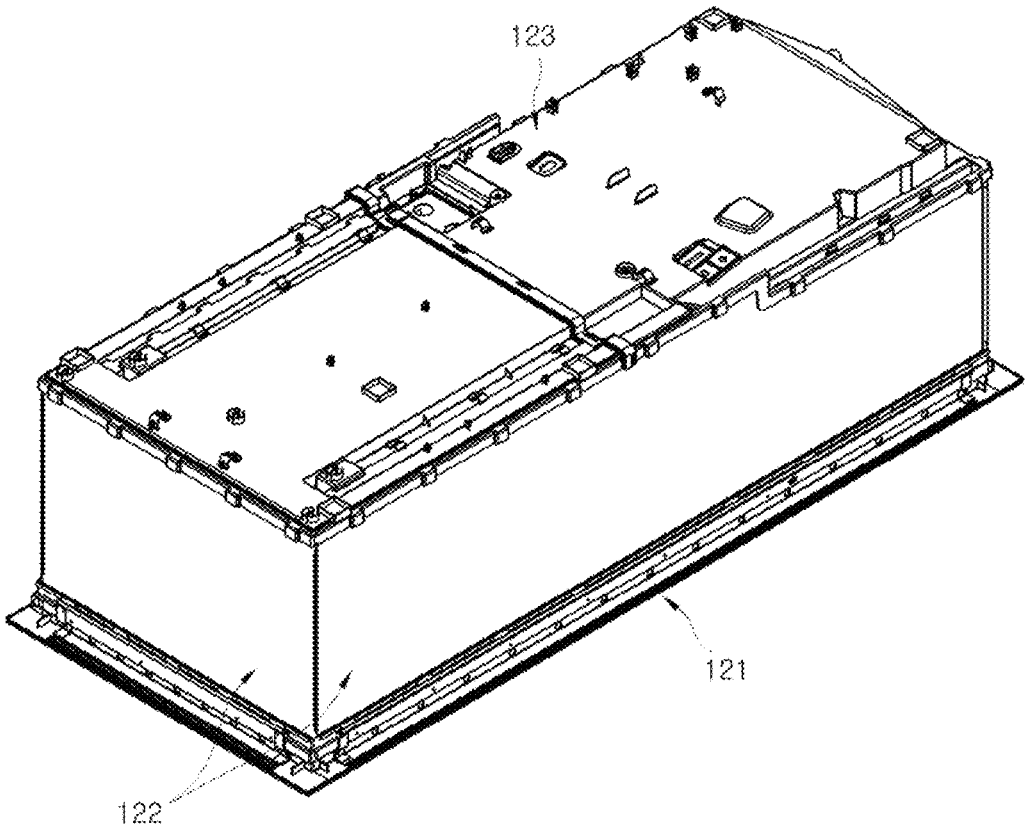

Subsequently, when the rear panel 123 is coupled to the rear ends of the side panels 122, the elastic portion 122*b* provided at the rear end of each of the side panels 122 is inserted into and supported by the rear coupling portion 123*a*, and thereby the manufacturing process of the inner case 12 is completed, as shown in FIG. 9.

After the inner case 12 manufactured as described above is disposed in the outer case 11, the insulator 13, such as urethane, is filled in a space between the outer case 11 and the inner case 12, and a manufacturing process of the body 10 is roughly completed.

In the embodiment, the side panels 122 are made of a metal material, but this is merely an example, and the side panel may be formed of a material such as a ceramic or marble which is difficult to be finely processed to form the storage compartment 12*a*.

Figure 10:
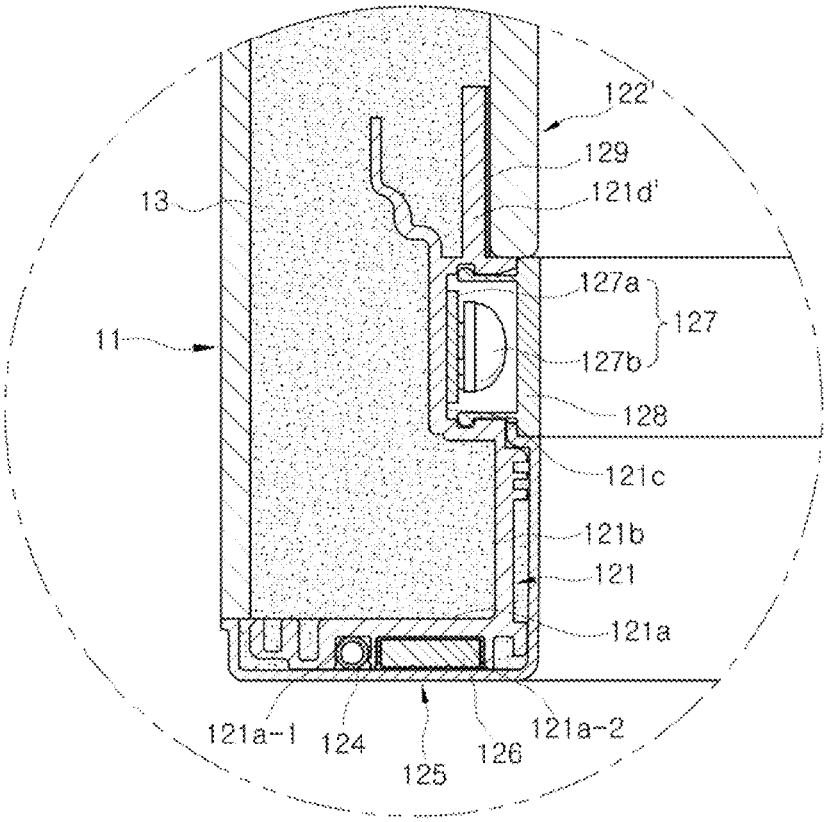
FIG. 10 is a partially enlarged view illustrating a state in which a front end of a side case is installed in a refrigerator in accordance with another embodiment of the present disclosure.

FIG. 10 illustrates a state in which the side panels 122 formed in a plate shape and formed of a material such as a ceramic or marble are installed on the front frame 121. As shown in the drawing, the front ends of the side panels 122 are fixed to the front coupling portions 121*d* using an adhesive material 129 such as a double-sided tape, an adhesive, or the like, and, although not shown in the drawing, the rear ends of the side panels 122 are inserted into and supported by the rear coupling portion 123*a* formed in a groove shape.

Accordingly, by forming the storage compartment using the plate-shaped side panel 122 as described above, characteristics of the storage compartment and a design of the inner surface of the storage compartment can be improved in various ways.

As is apparent from the above description, a refrigerator in accordance with one embodiment of the present disclosure has a storage compartment formed by coupling plate-shaped side panels to portions between a front frame and a rear panel so that a side surface of the storage compartment does not need to be formed as an inclined surface, thereby further increasing a capacity of the storage compartment.

In addition, in a refrigerator in accordance with one embodiment of the present disclosure, since four side surfaces of a storage compartment are formed by side panels formed in a plate shape, characteristics of the inside of the storage compartment can be easily improved by performing surface treatment on the side panels.

In addition, in a refrigerator in accordance with one embodiment of the present disclosure, since light is supplied to a storage compartment in upward, downward, leftward, and rightward directions, a user can easily confirm items stored inside the storage compartment.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising a body provided with a storage compartment, wherein:

the body includes an inner case configured to form the storage compartment, and the inner case includes:

a front frame including a front coupling portion, a plurality of side panels formed in a plate shape of a metal material, each of the plurality of side panels including:

a front end coupled to the front frame, a locking portion that engages the front coupling portion, and an elastic portion formed by a rear portion of the side panel, and a rear panel coupled to rear ends of the plurality of side panels and including a rear groove portion provided perpendicular to a front surface of the rear panel to receive the elastic portion.

2. The refrigerator according to claim 1, wherein:

the front frame is formed in a rectangular ring shape; and the plurality of side panels includes four side panels corresponding to four surfaces of the front frame so that an inner space of the four side panels forms the storage compartment.

3. The refrigerator according to claim 1, wherein:

the locking portion of each of the plurality of the side panels is formed by a part of the front end of the side panel being bent outward; and the front coupling portion is coupled to the front end of each of the plurality of the side panels.

4. The refrigerator according to claim 1, wherein:

the elastic portion is inserted into and supported by an inner surface of the rear groove portion.

5. The refrigerator according to claim 1, further comprising:

an outer case configured to accommodate the inner case therein; and an insulator filled in a space between the outer case and the inner case.

6. The refrigerator according to claim 2, further comprising a light source disposed at the front frame, wherein the front frame further includes:

a light source accommodating portion formed to be concave and accommodate the light source, and a light source cover configured to cover the light source accommodating portion.

7. The refrigerator according to claim 6, wherein the light source includes a substrate and a plurality of light emitting diodes arranged to be spaced apart from each other on the substrate.

8. The refrigerator according to claim 1, further comprising:

a hot water pipe through which hot water passes; and a magnet configured to generate a magnetic force, wherein a pipe accommodating groove in which the hot water pipe is accommodated and a magnet accommodating groove in which the magnet is accommodated are provided in a front surface of the front frame.

9. The refrigerator according to claim 8, further comprising a frame cover coupled to the front frame and configured to cover the pipe accommodating groove and the magnet accommodating groove.

10. The refrigerator according to claim 1, further comprising:

a light source accommodating portion formed to be concave in at least one surface of an upper surface, a lower surface, and both side surfaces of the storage compartment, wherein the light source accommodating portion extends vertically or laterally;

a light source including:

substrates extending in an extending direction of the light source accommodating portion, and a plurality of light emitting diodes arranged on the substrates to be spaced apart from each other in the extending direction of the light source accommodating portion; and a light source cover that is translucent.

11. The refrigerator according to claim 10, wherein the light source accommodating portion includes:

a pair of light source accommodating portions laterally extending on the upper and lower surfaces of the storage compartment, and a pair of light source accommodating portions vertically extending on both of the side surfaces of the storage compartment.

12. The refrigerator according to claim 10, wherein the light source cover that is translucent is formed of a translucent white material.

13. The refrigerator according to claim 6, wherein the light source cover is formed to diffuse light generated by the light source.

14. The refrigerator according to claim 10, wherein each of the upper surface, the lower surface, and the both side surfaces includes a light source accommodating portion.

* * * * *